United States Patent [19]

Maynard

[11] 3,943,850

[45] Mar. 16, 1976

[54] CORE HOLDER FOR STENCIL OR INK SCREEN

[75] Inventor: Michael Maynard, London, England

[73] Assignee: Gestetner Limited, London, England

[22] Filed: Sept. 14, 1973

[21] Appl. No.: 397,305

[30] Foreign Application Priority Data

Sept. 15, 1972 United Kingdom ..... 43012/72

[52] U.S. Cl. ..... 101/127.1

[51] Int. Cl.[2] ..... B41F 15/38

[58] Field of Search ..... 101/116, 121, 122, 127.1, 101/128.1, 132, 132.5, 141, 415.1; 242/67.3, 67.5, 201

[56] References Cited

UNITED STATES PATENTS

| | | | |
|---|---|---|---|
| 1,017,984 | 2/1912 | Martin | 242/67.3 R |
| 1,958,068 | 5/1934 | Raiche | 53/118 X |
| 3,491,684 | 1/1970 | Borinsky | 101/132 |
| 3,554,465 | 1/1971 | Marukawa | 242/201 |
| 3,750,573 | 8/1973 | Haeusler | 101/415.1 |
| 3,788,221 | 1/1974 | Borneman | 101/132 X |
| 3,793,950 | 2/1974 | Kaneko et al. | 101/130 X |

*Primary Examiner*—Edgar S. Burr
*Assistant Examiner*—R. E. Suter
*Attorney, Agent, or Firm*—Fleit & Jacobson

[57] ABSTRACT

A device for rolling up onto a core a stencil or ink screen being removed from a duplicator, in which a pair of rotatable core holding members is located adjacent the or a duplicator cylinder and at least one of the members is driveable from the cylinder by means of a drive wheel carried on a pivotable lever.

15 Claims, 2 Drawing Figures

CORE HOLDER FOR STENCIL OR INK SCREEN

THIS INVENTION relates to stencil duplicators and more particularly to a device useful for assisting in removing stencils or ink screens from such machines. Stencils and ink screens are at present removed entirely by hand and it is an object of this invention to provide mechanical means for assisting the removal.

According to one aspect of the present invention we provide a duplicator including means located adjacent the or a cylinder of the duplicator for rolling up a stencil or screen as it is peeled from the duplicator. With such a device, one of the ends of the stencil or screen may be removed from the cylinder of the machine, or in the case of a twin cylinder machine, one of the cylinders, and attached to said means which then roll up the stencil or screen. A slot or other attachment means could, of course, be provided in any suitable form of means to roll up the stencil or screen.

More particularly, according to a second aspect of the present invention, we provide a stencil or screen removing device comprising a rotatable core positionable adjacent the cylinder or a stencil of a duplicator. With this arrangement, when a stencil or ink screen is to be removed, one of its ends can be lifted from the cylinder and placed on the core whereon it may adhere due to the ink on it. Alternatively an end can be fitted in a slot in the core, or connected to the core by other attachment means. The core and machine cylinder are than rotated to roll the stencil or screen up.

According to a third aspect of the invention we provide a device for removing a stencil or screen from a duplicator cylinder, comprising rotatable core holding members and means for mounting such members adjacent the or a cylinder of a duplicator.

The core may take any practical form, for instance it could be a flat card, but in a presently preferred construction it is in the form of a roller, and is preferably tubular, being made, for instance of thin cardboard or plastics material. The core is expected to be extremely simple and cheap to make, so that a stencil which is no longer required may be discarded with a core within it, or a stencil or screen can be stored for a time when wrapped on the core.

If a stencil or screen is being removed from a machine cylinder, its free end can be attached to the core by the adhesion provided by the ink which will be on the stencil. It is also possible to remove a stencil by initially detaching its other, or "head" end from the cylinder. Stencil heads usually include a stiff strip by which the stencil is initially attached to the cylinder. The core or other means to roll up the screen or stencil can have a slot to receive this strip, or projections to engage some or all of the perforations normally provided in the strip. Any other form of attachment means may of course be provided.

Similar considerations apply to removing ink screens, for instance for temporary storage while ink of a different color and therefore a different screen is used. Again, the screen can be removed with either end leading into the roll, and attachment means can be provided, and can typically comprise one or more slots to accommodate the springs and header bar normally provided at the free end of the screen. The springs could, alternatively, be clipped to the core or whatever other means are provided for rolling the screen up.

The disposition of the apparatus relative to the cylinder will depend on which of the head or free end of the screens and stencils are to lead into the roll.

The means to roll up the stencil or screen is preferably drivable in order to roll up a screen or used stencil. It is preferred for the drive to be taken from the actual cylinder of the machine, although it could equally be taken from the main machine drive unit by another mechanical route, or have its own drive unit. Where a core is used, at least one of the core engaging members is preferably drivable in this way.

One way of taking the drive from the cylinder is to provide one or more drive wheels which are movable to engage the cylinder surface and are respectively drivingly connected to, for instance, one or both of the core engaging members. A preferred aspect of the invention is to locate the core engaging members or other means to roll up a screen or stencil together with one or more respective drive wheels on pivotable levers which allow the drive wheels to be movable in and out of engagement with the cylinder.

Thus, more particularly, according to the second aspect of the invention, we provide apparatus for holding a core adjacent the or a cylinder of a stencil duplicating machine including two core engaging members each mounted on a lever, at least one member being drivingly connected to a drive wheel mounted on the associated lever, the levers being rotatable to cause the drive wheel to engage the cylinder.

The levers are preferably mounted on a common bar.

It has been found advantageous to employ an arrangement wherein the or each such drive wheel is in driving contact with a secondary wheel coaxial with and fixed to a core holding member, where provided.

In the case of a core in the form of a roller, it has been found that making the secondary wheel smaller than the drive wheel and the drive wheel about the same diameter as the roller, so that the roller surface speed will be greater than the cylinder surface speed, ensures tension in the stencil or screen during removal from the cylinder which will provide a clean and neat removal and rolling up. A suitable ratio of roller to cylinder surface speeds is $1^1/3:1$. A similar arrangement can obviously be achieved with other shapes of core, or with other means to roll up the screen or stencil.

Where the levers are mounted on a common bar, a control means to control rotation of the bar and engagement of the drive wheels with the cylinder can be provided. One such control means comprises a two-member articulation linkage of which one member is rotatable with the bar, the second member being pivoted to the first member and spring urged in a direction to cause engagement of the drive wheels with the cylinder. Preferably a fixed pin engages in a slot in said second member, the slot is long enough to allow for movement of the second member between positions in which the drive wheels are engaged and disengaged with respect to the cylinder, and the slot has a recess at one end to accommodate the pin to hold the second member against the spring action in a position holding the drive wheels clear of the cylinder.

In order to provide for simple loading and removal of cores, one of the core engaging members is preferably axially slidable away from the other to allow the cores to be placed in or taken from a position between them. Where the members are mounted on levers, the appropriate lever can be slidable.

Where the cores are of tubular form, the core engaging members could be part-conical, but in one preferred form they are discs, preferably with knurled peripheries, to fit inside the ends of tubes forming the cores. The secondary drive wheels, if provided, preferably also have knurled peripheries, while the drive wheels are preferably provided with frictional surfaces or tyres, conveniently having peripheral grooves in which rubber or elastomeric O-rings are placed. This also ensures that the cylinder of the machine is not damaged. The wheels and discs may be of plastics material.

As a further feature, it is possible to arrange for automatic engagement between the drive wheels and the cylinder when the cylinder is in the correct rotational position to permit detaching the end of the screen or stencil which is to lead into the roll. The provision of a suitably shaped cam, suitably on the cylinder axis, to engage for instance one of the levers, or a projection thereon, is one way in which this can be achieved.

The invention also provides a stencil duplicating machine including such apparatus and/or a stencil or screen removing device.

In order that the invention may be more clearly understood, the following description is given, merely by way of example, with reference to the accompanying drawings, in which:

FIG. 1 shows an apparatus according to the invention mounted between left and right hand side frames 1, 2 of a twin cylinder duplicating machine adjacent the upper cylinder 20 thereof.

Figure 1:
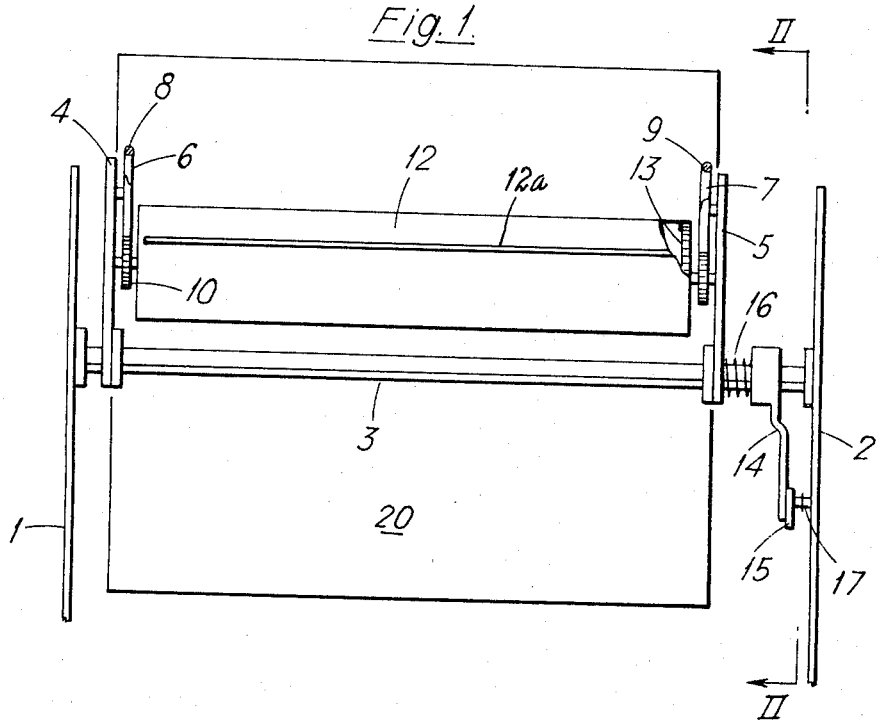
FIG. 1 is an elevation of one form of apparatus according to the invention which is particularly adapted for removing stencils.

The apparatus comprises a bar 3, which has a D-section, pivoted between the side frames.

A cranked lever 4 is fixed to the bar 3 near the left hand side frame 1, while a second cranked lever 5 is slidable on, but rotatable with, the bar 3 near the right hand side frame 2.

At the outer end of each cranked lever 4, 5 is rotatably mounted a drive wheel 6, 7. These drive wheels are of plastics material and have peripheral grooves in which are located O-rings 8, 9 serving as tyres to engage the cylinder 20.

The drive wheels 6, 7 are in surface contact with knurled, plastics, secondary drive wheels 10, 11, respectively, freely rotatably mounted on the levers 4, 5. Coaxial with, and fixed to rotate with, the secondary drive wheels are core holding members in the form of knurled discs 13 on which is mounted a core roller in the form of a hollow cylinder 12. Each secondary drive wheel 10 or 11 and its associated disc 13 may be integral. The core roller 12 obscures the left hand disc, but is shown cut away in part at its right end to show part of one of the two discs 13.

A control means for the apparatus is capable of pivoting the two levers simultaneously and includes a two-lever articulation linkage 14, 15, of which a first lever 14 is fast with the D-shaped bar 3 between the right hand lever 5 and side frame 2 for rotation with the lever 5. Between lever 5 and lever 14 is a compression spring 16 on the bar 3 urging lever 5 to the left as shown.

Figure 2:
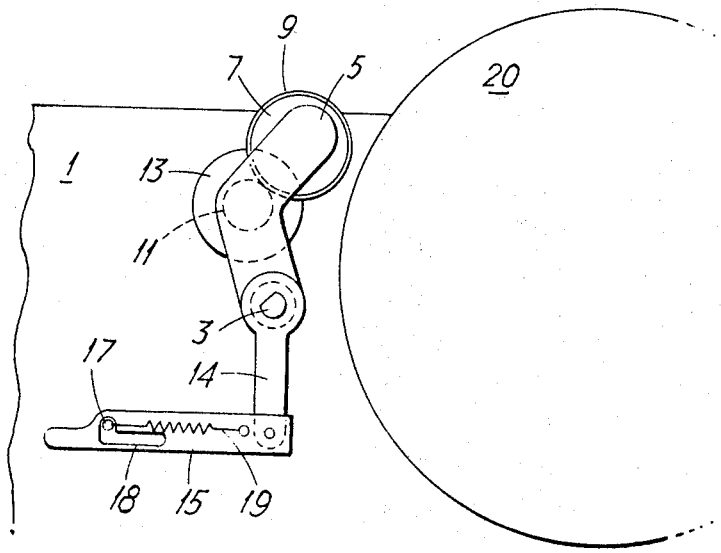
FIG. 2 is a view of the line II—II of FIG. 1.

The control means shown clearly in FIG. 2 comprises, in addition to pivoted levers 14, 15 of the articulation linkage, a pin 17 on side frame 2 engaging in an L slot 18 in lever 15. A tension spring 19 connects pin 17 to lever 15, urging lever 15 to the left. Leftward movement of lever 15 would cause clockwise rotation of lever 14 and thus bar 3, bringing drive rollers 6, 7 into contact with the machine cylinder, shown at 20 in FIG. 2. Lever 15 can be retained in its position as shown in FIG. 2, however, by the pin 17 engaging in the recess formed by the shorter limb of the L slot at the left end of the slot.

The apparatus is operated as follows.

When a stencil is to be removed from the cylinder 20, a core roller 12 is placed on and between the discs by moving lever 5 to the right to allow positioning of the core roller and releasing it again to engage the core roller. Spring 16 causes the core roller 12 to be firmly held.

Lever 15 of the control mechanism is then simply raised, whereon tension spring 19 can rotate bar 3 until drive wheels 6, 7 contact cylinder 20 on either side of a stencil thereon.

The free end of the stencil is lifted manually from the cylinder, placed on the core roller 12 and pressed thereagainst. The ink and moisture present will provide sufficient adherence.

Appropriate rotation of the cylinder 20 will then cause the stencil to be rolled up on roller 12, and thus removed from the cylinder.

The roller 12 can be simply removed by sliding lever 5 on bar 3 (see FIG. 1), and the drive wheels 9 can be disengaged from the cylinder by simply pressing lever 15 of the control means to the right (as viewed in FIG. 2) until pin 17 engages in the recess in slot 18 to hold the lever 15 with the spring 19 in tension.

Lateral movement of lever 5 along the bar 3 and movement of the drive wheels to and from the engaging position with the cylinder could be arranged to occur in response to one control movement. Thus, if one of the levers of the control means is arranged to engage a camming surface on rotational movement of bar 3, a simultaneous movement axially of bar 3 could be transmitted to lever 5. Alternatively lever 5 could engage a camming surface for this purpose, and many other arrangements to provide this result can be envisaged allowing a roller to be placed between the discs and the discs moved together simultaneously with engagement of the drive wheels with the cylinder.

It is also possible for stencils themselves to form the required roller, rather than to provide a separate roller. This can be achieved by adapting the stencil backing sheet, which is normally provided with a stencil and removed therefrom once the stencil has been placed on the duplicating machine, such that the backing sheet can be rolled up to provide the roller to be fitted on the roller engaging members.

Finally, it is known from British Patent Specification No. 1,185,100 that for loading stencils onto the cylinder(s), it is useful to pass them over a rotatable feed roller parallel to the cylinder and under a ridge provided on the machine cover. The result is a tensioning and smoothing of the stencil as it is loaded, making correct loading easier. A core of this invention or the bar 3 of the core holder, may be positioned to serve also as this feed roller, so that a dual function may be served by the invention.

The embodiment particularly described above could also be used for rolling up screens, particularly with the slot 12*a* or other attachment means (not shown) provided to accommodate the heading bar and springs. The apparatus could also, if it were positioned on the other side of the cylinder, remove a stencil with the head leading, again, particularly the slot 12*a* is provided to receive the head strip on the stencil.

The embodiments of the invention, in which an exclusive privilege or property is claimed, are defined as follows:

1. A device for the use with a stencil duplicator having a rotary cylinder about which is wrapped a stencil or ink screen, said device serving the purpose of receiving the stencil or ink screen as it is removed from the rotary cylinder, comprising:

a. a frame;

b. a pair of core holding members freely rotatably mounted on said frame and axially aligned for releasably holding a core therebetween adjacent to and parallel with the rotary cylinder of a stencil duplicator;

c. lever means mounted adjacent at least one of said core holding members to be pivoted toward and away from the rotary cylinder of a stencil duplicator;

d. a drive wheel freely rotatably carried by said lever means and being drivingly connected with said one core holding member whereby rotation of said drive wheel produces rotation of said core holding member;

e. mounting means on said frame mounting said lever means for pivotal movement between a first position whereat the drive wheel carried by said lever means is in rolling contact with an adjacently located rotary cylinder of a stencil duplicator and is driven thereby whereupon a stencil or ink screen carried on the rotary cylinder would be removed and taken up on a core releasably held by said core holding members after the stencil or ink screen has been started on the core and a second position whereat the drive wheel would be out of rolling contact with adjacently located rotary cylinder; and f. pivoting means for pivoting said lever means between said first and second positions.

2. A device according to claim 1 wherein the core holding members are discs with knurled peripheries.

3. A device according to claim 1 wherein one of the core holding members is movable towards and away from the other.

4. A device according to claim 1 wherein said lever means includes a pair of levers one located adjacent each said core holding member.

5. A device according to claim 4 wherein each said core holding member is mounted on the adjacent lever.

6. A device according to claim 5 wherein there are two drive wheels, one carried by each said lever.

7. A device according to claim 6 wherein a second drive wheel is fixed to rotate with each said core holding member, said second drive wheels being drivingly engaged with said drive wheels.

8. A device according to claim 7 wherein said drive wheels are of large diameter than said second drive wheels.

9. A device according to claim 5 wherein said mounting means comprises a bar rotatably mounted on said frame, and the two levers are non-rotatably secured on said bar.

10. A device according to claim 9 wherein said pivoting means comprises a two member articulation linkage of which one member is rotatable with the bar, the second member being pivoted to the first member and spring urged in a direction to cause said bar to pivot to said first position.

11. A device according to claim 10 wherein a fixed pin engages in a slot in said second member, the slot being long enough to allow for movement of the second member to pivot the bar between its first and second positions, and the slot having a recess at one end to accommodate the pin to hold the second member against the spring action while holding the bar in the second position.

12. A device according to claim 1 further including a core releasably held by said core holding members.

13. A device according to claim 12 wherein the core has a slot to receive an end of said stencil or screen.

14. A device according to claim 12 wherein said core is cylindrical roller.

15. A device according to claim 14 wherein said core is hollow.

* * * * *